US006106112A

United States Patent [19]

Okubo et al.

[11] Patent Number: 6,106,112

[45] Date of Patent: Aug. 22, 2000

[54] INK FEED CONTAINER

[75] Inventors: Katsuhiro Okubo; Katsuhiko Iida, both of Nagano, Japan

[73] Assignee: Seiko Epson Corporation, Tokyo, Japan

[21] Appl. No.: 09/018,334

[22] Filed: Feb. 4, 1998

[30] Foreign Application Priority Data

Feb. 10, 1997 [JP] Japan ..... 9-041524

[51] Int. Cl.[7] ..... B41J 2/175; B41J 2/195

[52] U.S. Cl. ..... 347/86; 347/7

[58] Field of Search ..... 347/86, 7, 49

[56] References Cited

U.S. PATENT DOCUMENTS 4,855,762 8/1989 Suzuki .

FOREIGN PATENT DOCUMENTS

| | | | |
|---|---|---|---|
| 0 419 876 | 4/1991 | European Pat. Off. | B41J 2/005 |
| 0 516 088 | 12/1992 | European Pat. Off. | B41J 2/175 |
| 0 715 958 | 6/1996 | European Pat. Off. | B41J 2/175 |
| 31 31 944 | 3/1982 | Germany | B41J 27/00 |
| 32 20 939 | 1/1983 | Germany | B41J 27/00 |
| 36 44 095 | 7/1988 | Germany | B41J 27/00 |
| 63-115757 | 5/1988 | Japan | 347/7 |
| WO 96/34752 | 11/1996 | WIPO | B41J 2/165 |

OTHER PUBLICATIONS

JP 58 194552 A (Canon KK) Nov. 12, 1983 *Abstract.
JP 58 211482 A (Canon KK) Dec. 8, 1983 *Abstract.
JP 59 194855 A (Canon KK) Nov. 5, 1984 *Abstract.

*Primary Examiner*—N. Le
*Assistant Examiner*—Judy Nguyen
*Attorney, Agent, or Firm*—Sughrue, Mion, Zinn, Macpeak & Seas, PLLC

[57] ABSTRACT

An ink feed container that accommodates a plurality of ink storage bags in a small space. Ink storage bags are accommodated in a case main body separated by a partitioning plate. Detectable pieces of detection plates, which are mounted on the ink storage bags, are positioned so that they deviate from each other. Pointed ends on the detectable pieces are arranged at uniform heights. When an ink storage bag becomes empty, the corresponding detectable piece displaces a common detection lever.

10 Claims, 6 Drawing Sheets

INK FEED CONTAINER

BACKGROUND OF THE INVENTION

1. Field of the Invention

The present invention relates to an ink feed container used in an ink jet printing apparatus, and more specifically, in a color ink jet printing apparatus.

2. Description of Related Art

An ink feed container used in an ink jet printing apparatus generally has a structure, as in Japan Patent Laying-Open Gazette Showa 59-194855 (1984), wherein a single ink storage bag is accommodated inside a flat ink cassette with a part of detection plate, which is mounted thereon, facing a detecting device. This type of ink feed container, however, is designed to accommodate one ink storage bag in one ink cartridge. Therefore an ink jet printing apparatus that forms color images by using various kinds of ink requires a large amount of space to accommodate multiple ink cartridges. In addition, an equal number of detecting devices as the number of ink cartridges are required. These two requirements lead to increased production costs.

SUMMARY OF THE INVENTION

In view of the problems described above, the present invention provides an ink feed container for ink jet printing apparatuses, especially those which use many kinds of ink, that can reduce accommodation space requirements and reduce costs as much as possible. The ink feed container of the present invention accommodates a plurality of ink storage bags in a case main body with partitioning members. A common positioning part for the positioning and locking of respective ink feed ports of the ink storage bags is provided on an end wall inner surface of the case main body. Each of the plurality of ink storage bags is provided with its own detection plate which is folded to form a detectable piece that is positioned to be deviated from one another to face a common visual observation window hole and detecting means.

This structure allows the accommodation space to be reduced as much as possible by accommodating the plurality of ink storage bags in the single case main body. It also allows the production costs to be reduced by performing detection with a common detecting means.

DESCRIPTION OF THE PREFERRED EMBODIMENT

Figure 1:
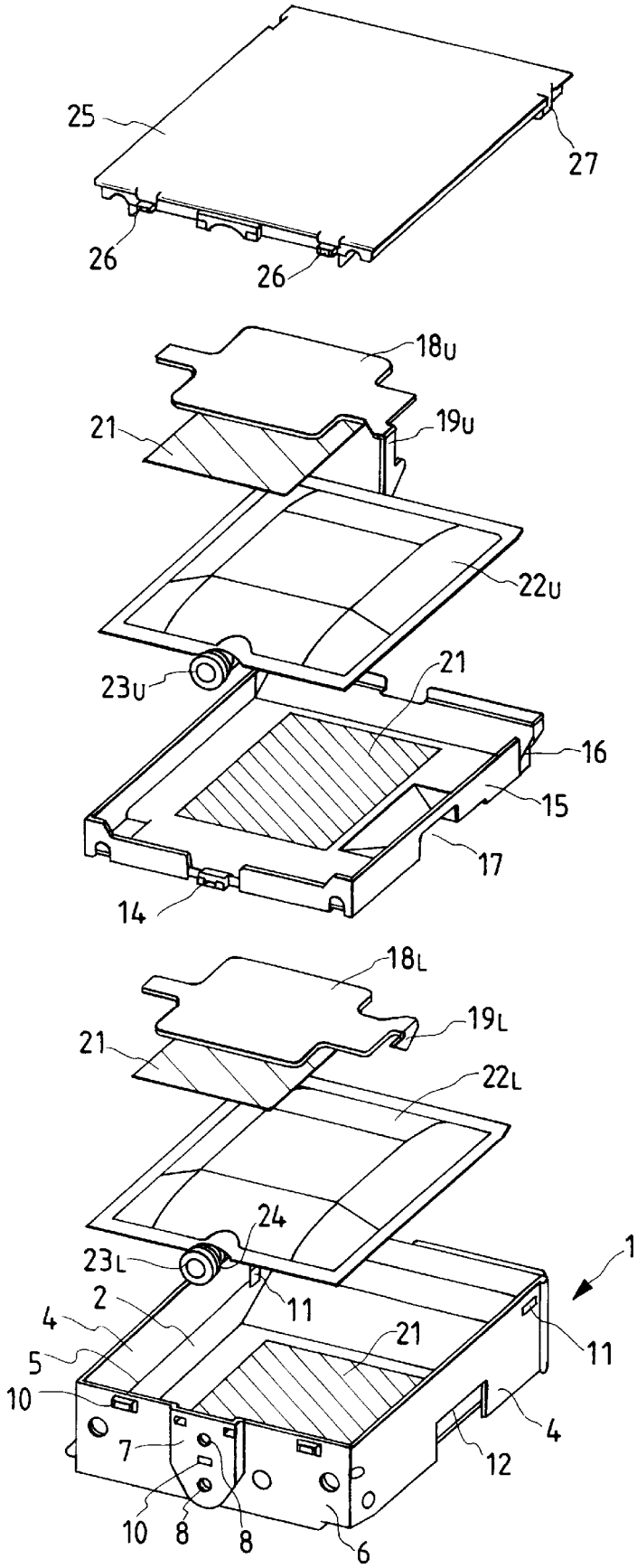
FIG. 1 is a disassembled perspective view of the first embodiment of an ink feed container.
Figure 2:
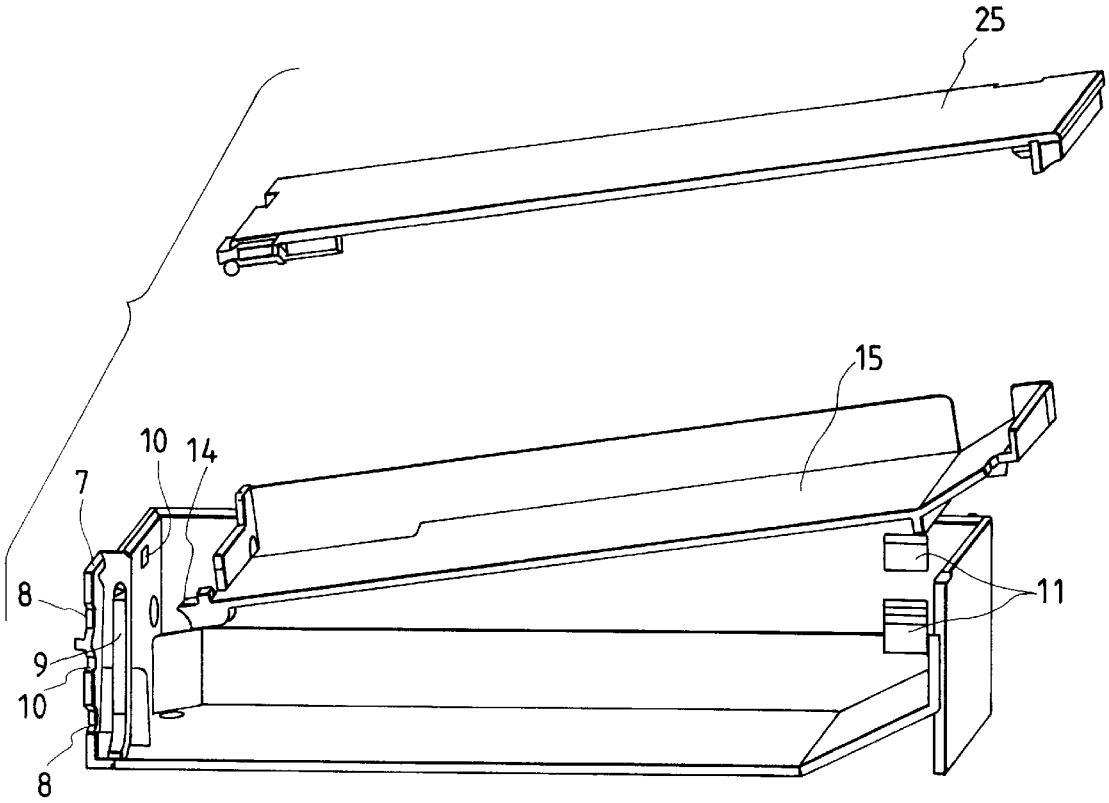
FIG. 2 is a perspective view which shows a cross section of an assembly state of the same container.
Figure 3:
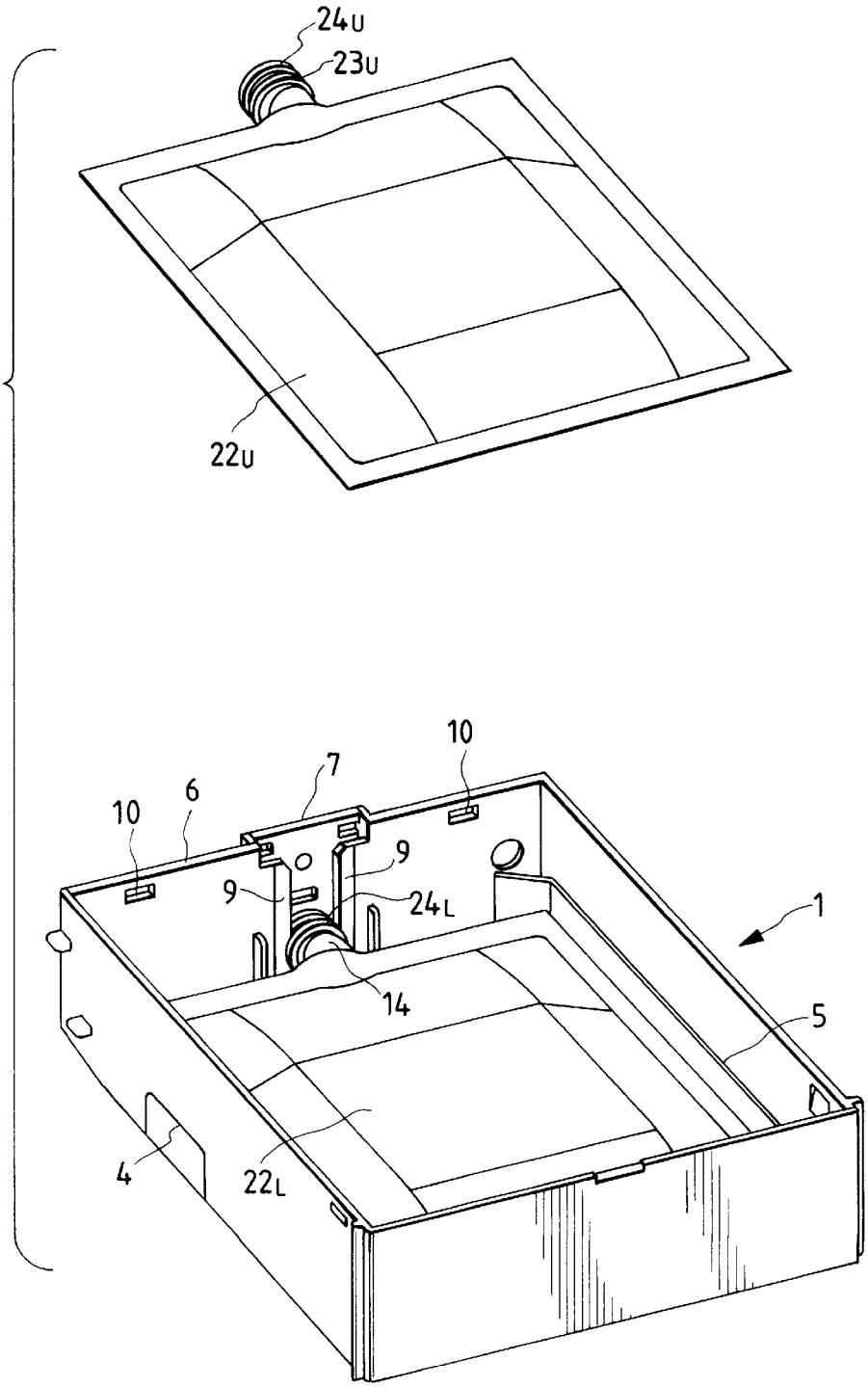
FIG. 3 is a drawing which shows a state wherein ink storage bags are in the process of being accommodated inside the same container.
Figure 4:
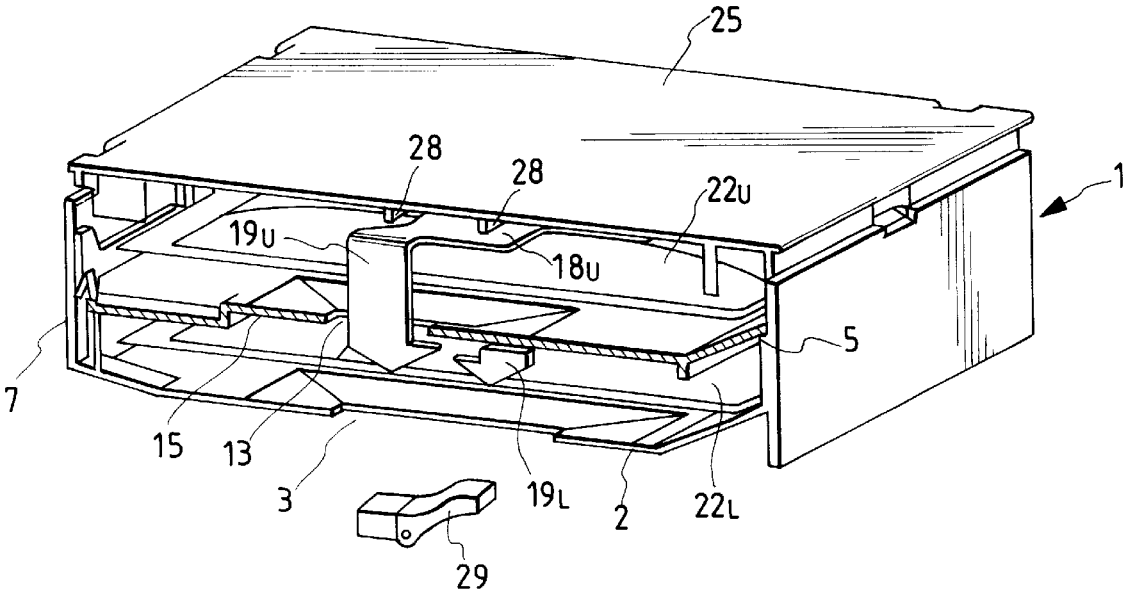
FIG. 4 is a drawing which shows the interior parts of the same container.

An embodiment of the present invention will now be described. FIGS. 1 through 6 show an ink feed container of an embodiment of the present invention with a structure that can accommodate two ink storage bags. The container has a case main body 1 which is formed of resin in a box-like shape. An elongated hole 3 for insertion of detectable pieces 19U and 19L is formed at a center of one side of a bottom plate 2 of case main body 1. Step parts 5 are formed on inner surfaces of the lateral side walls 4 at vertical center parts for mounting a partitioning plate 15 that is provided with a hole 13 for insertion of the detectable piece 19U at a center of one side. A U-shaped positioning recess 7 for positioning and locking ink feed ports 23U and 23L, which respectively protrude from ends of ink storage bags 22U and 22L, is formed at a central part on the front end wall 6 of case main body 1. Positioning recess 7 protrudes outward as shown in FIG. 3. Locking ribs 9 are formed on both sides of positioning recess 7 and protrude inward. This allows for correct positioning and locking of ink storage bags 22U and 22L through engagement of grooves 24U and 24L on respective ink feed ports 23U and 23L with locking ribs 9 when ink storage bags 22U and 22L are placed inside case main body 1.

In case main body 1, upper and lower engagement holes 10 are provided at two levels in front end wall 6, while upper and lower engagement projections 11 are provided at the same positions at two levels on inner rear end surfaces of lateral side walls 4. As shown in FIG. 2, if the rear end of partitioning plate 15 is dropped to be positioned while an engagement projection 14, that is provided on the front end edge of partitioning plate 15, is engaged in lower engagement hole 10 in front end wall 6, partitioning plate 15 is fastened by engagement of engagement hooks 16. Engagement hooks 16 are provided on rear parts of lateral side edges of partitioning plate 15. Lower engagement projections 11 are provided on lateral side walls 4.

If the rear end of lid body 25 is placed such that it covers case main body 1 while engagement projections 26, which are provided on the front end edge of lid body 25, are engaged in upper engagement holes 10 in front end wall 6, lid body 25 is fastened by engagement of locking hooks 27, which are provided on rear parts of the lateral side edges of lid body 25, and upper engagement projections 11 on lateral side walls 4.

Two control ribs 28, which are narrower than detection plate 18U, are formed on lower surface of lid body 25 and protrude from a central part of lid body 25. Control ribs 28 control the tilt of upper detection plate 18U to prevent detectable piece 19U and the inner surface of the case main body lateral side wall 4 from coming into contact. As shown in the drawings, detection plates 18U and 18L, which detect an approaching end of an ink feed, are formed as narrow plates and are placed respectively on the upper central surfaces of upper and lower ink storage bags 22U and 22L, which are accommodated separately inside case main body 1. One side of each detection plate 18U and 18L is molded downward so that they deviate from each other and form detectable piece 19U and 19L, respectively.

Detectable pieces 19U and 19L are formed in different lengths so that the lower ends thereof are positioned at the same height when both ink storage bags 22U and 22L are fully filled and, if either of the ink storage bags 22 becomes flat as a result of the ink remaining inside the bag running empty, the lower end of detectable pieces 19U and 19L, which has descended along with the corresponding bag, pushes and displaces a detection lever 29 that is provided exactly under case main body 1 to output an ink feed end signal.

Figure 5:
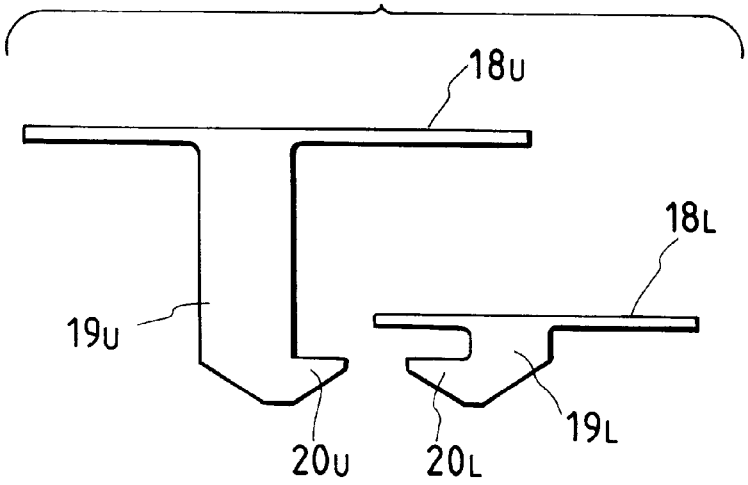
FIG. 5 is a drawing which shows the detectable pieces.
Figure 6:
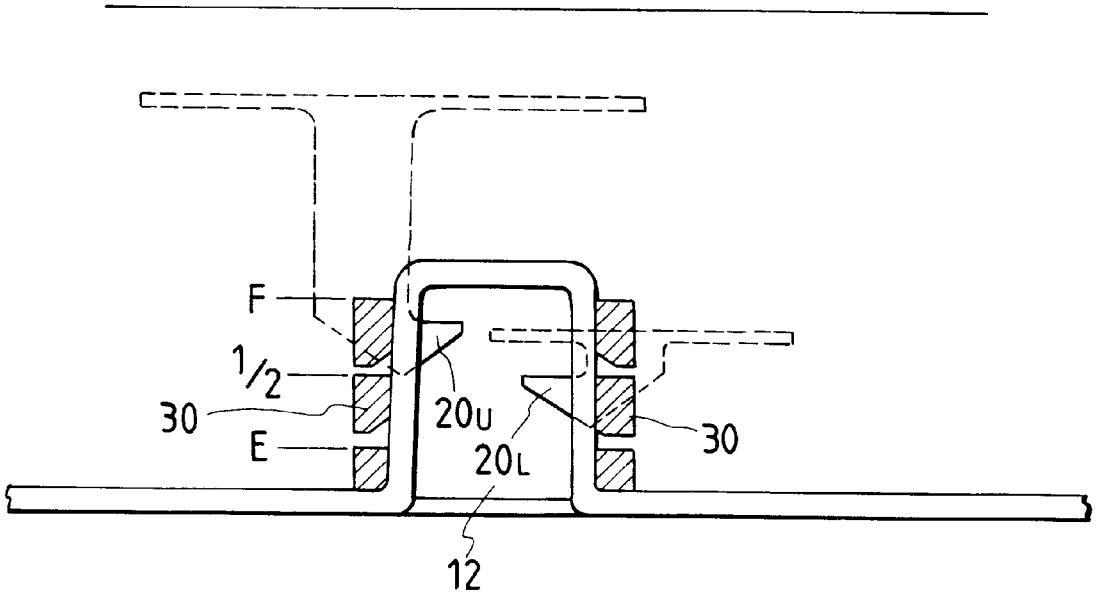
FIG. 6 is a drawing which shows the remaining ink amount detecting device.

As shown in FIG. 5, pointers 20U and 20L point inward and are formed at the lower ends of detectable pieces 19U and 19L by squaring the inner edges thereof. As shown in FIG. 6, pointers 20U and 20L are configured so that they are exposed from mutually confronting side edges of a window hole 12 in case main body 1 and window hole 17 in partitioning plate 15 to allow visual observation of remaining ink amounts.

Index marks 30, formed in an irregular pentagonal shape which includes extended lines of two sides of either of pointers 20, are provided on both sides of window hole 12. For example, index marks 30 are formed representing full amount positions, half amount positions and empty positions; so that the remaining ink amounts can be observed by viewing the upper sides of pointers 20.

Holes 8 that match ink feed ports 23 for insertion of ink feed needles are provided in s positioning recess 7 as shown in the drawings.

The ink feed container discussed above has been drawn, for convenience, as a horizontal stacking type container, and the discussion has been based on a horizontal stacking type container. However, the ink feed container in its preferred embodiment is configured such that it is stored vertically, on either one side, or on both sides, of the printer main body, like books.

Inside case main body 1 of a vertical configuration, two ink storage bags 22U and 22L, which store, for example, two inks of the same color but of different shades, are accommodated in two spaces that are partitioned by partitioning plate 15 and fastened by double-sided adhesive tapes 21 on one face of the partitioning plate 15 and on one face of bottom plate 2, respectively.

When the detection plates 18U and 18L are attached to ink storage bags 22U and 22L, respectively, detectable pieces 19U and 19L, which are formed by folding detection plates 18U and 18L downward at one side, as shown in the figure, are aligned at the same height with the lower ends thereof, pointing at common detection lever 29 through hole 3 in bottom plate 2, and at positions deviating from each other. Therefore, when the ink jet printing apparatus, which is mounted with the case main body 1 that accommodates ink storage bags 22U and 22L in a vertical configuration, carries out printing, detection plates 18U and 18L, which are respectively mounted on the central parts of the upper surface of the ink storage bags 22U and 22L, are displaced approximately parallel with-bottom plate 2 together with ink storage bags 22U and 22L, which shrink along with ink consumption.

To describe this displacement more exactly in a case of a vertical stacking type container, detection plates 18U and 18L are displaced from a tilted state by being revolved as one end as the fulcrum, and the displacement is observed with the horizontal pointers 20U and 20L being exposed from both side edges of the window hole 12.

When either ink supply bag becomes empty, the corresponding detectable piece 19, which travels through hole 3 in bottom plate 2, comes into contact with detection lever 29, which is positioned exactly thereunder, and displaces detection lever 29 downward to output an ink supply end signal.

If detection plate 18U, which is mounted on ink storage bag 22U, starts to tilt when ink storage bag 22U, which is mounted on partitioning plate 15, shrinks and deforms in the ink consumption process, control ribs 28, which protrude from the rear surface of lid body 25, control the tilt, thereby effectively preventing detectable piece 19U from coming into contact with lateral side walls 4 of case main body 1.

Figure 7:
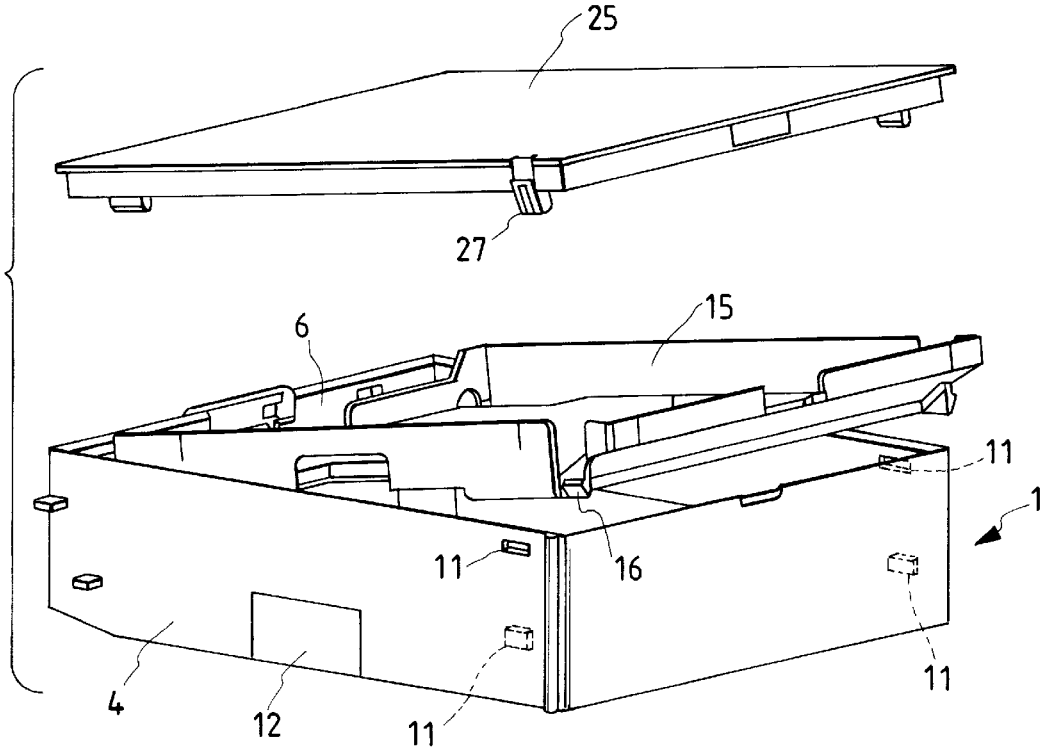
FIG. 7 is a perspective view of a second embodiment of the present invention.

FIG. 7 shows a second embodiment of the present invention related to attachment mechanisms of partitioning plate 15 and lid body 25. In this embodiment, engagement projection 14, when engaged in lower engagement hole 10, lower engagement hole 10, engagement hooks 16, when engaged in lower engagement projections 11, and lower engagement projections 11 are all in one plane. Likewise, engagement projections 26, when engaged in upper engagement hole upper engagement holes 10, engagement hooks 27, when engaged in upper engagement projections 11, and upper engagement projections 11 are all in another plane.

This embodiment allows common use of metal patterns and assembly of partitioning plate 15 and lid body 25 onto case main body 1 in identical actions.

Figure 8:
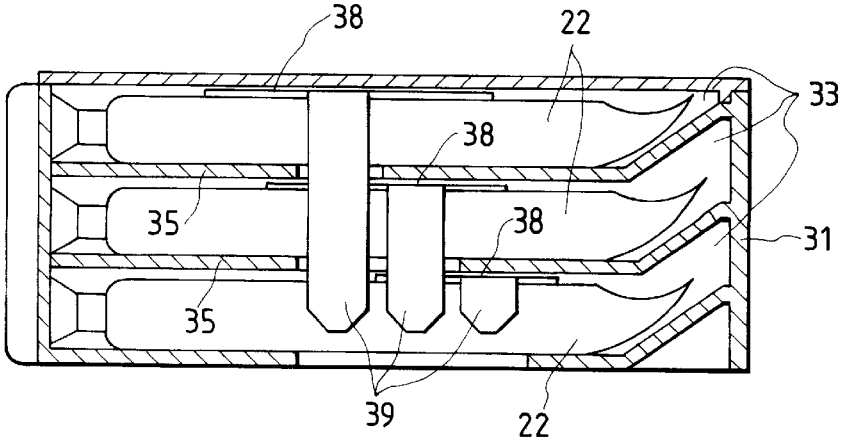
FIG. 8 is a lateral side sectional view of another alternative embodiment of the present invention.

FIG. 8 shows another alternative embodiment of the present invention that accommodates three ink storage bags 22 in a single case main body 31. In this embodiment three ink storage bags 22 are individually accommodated in three storage spaces 33 inside case main body 31. Case main body 31 is partitioned with two partitioning plates 35. A detection lever is pushed by any one of the folded down detectable pieces 39 of detection plates 38 that are respectively mounted on ink storage bags 22. The lower ends of detectable pieces 39 are positioned at the same height when all of the ink storage bags 22 are fully filled, but disposed at positions deviating from one another.

As described above, in the present invention ink feed ports of a plurality of ink storage bags are positioned and locked by the positioning part which is provided on the inner surface of the end wall of the case main body. This allows the ink storage bags to be accurately mounted into the printing apparatus in the same way as a conventional single pack cartridge so that the ink storage bags can communicate with ink feed needles. Accommodating a plurality of ink storage bags in a single case main body and positioning the detectable pieces, which are mounted on the ink storage bags in such manner that the pointed ends of the detectable pieces are positioned at the same height, but deviated from one another to face the common detecting means, allows a plurality of ink storage bags to be stored in a space as small as possible and reduces the number of detecting means, which also reduces costs.

Moreover, the formation of the confronting pointers at the ends of the detectable pieces and exposure of these pointed ends from both sides of the window hole, allows for the visual observation of the amount of remaining ink through the single window hole. Furthermore, the arrangement of the engagement parts that are provided on the partitioning plates and the lid body for the engagement with the case main body at the same positions allows for common use of metal patterns and assembly of the partitioning plate and lid body onto the case main body in identical actions, simplifying the automatic assembly process.

What is claimed is:

1. An ink feed container comprising:

a plurality of ink storage bags, each having an ink feed port;

a case main body;

at least one partitioning member; and a common positioning part provided on an end wall inner surface of said case main body for positioning and locking of said respective ink feed ports;

a plurality of detection plates, each of said plurality of detection plates being attached to each of said plurality of ink storage bags, respectively, and each of said plurality of detection plates having a detectable piece formed thereon, each of said detectable pieces having a pointed end;

wherein said plurality of ink storage bags are accommodated in said case main body and separated from each other by said at least one partitioning member; and wherein each of said detectable pieces is arranged such that said pointed end of said each of said detectable pieces is approximately uniformly positioned with respect to said case main body when each of said ink storage bags is fully filled.

2. An ink feed container comprising:

a plurality of ink storage bags;

a case main body;

at least one partitioning member; and a plurality of detection plates, each folded in an L shape to form a detectable piece with a pointed end;

wherein said plurality of ink storage bags are accommodated in said case main body and separated from each other by said at least one partitioning member;

wherein each one of said detection plates is attached to each of said plurality of ink storage bags, respectively; and wherein each of said detectable pieces is arranged such that said pointed end of each of said detectable pieces is approximately uniformly positioned with respect to said case main body when each of said ink storage bags is fully filled.

3. An ink feed container as claimed in claim 2 further comprising:

a member; and control ribs, provided on a surface of said member;

wherein said member is positioned such that said control ribs are a short distance from one of said detection plates attached to one of said ink storage bags, when said one of said ink storage bags is fully filled; and wherein said control ribs control the inclination of said one detection plate, while said one ink storage bag is being emptied, to prevent said one detection plate detectable piece from coming into contact with a lateral side wall of said case main body.

4. An ink feed container comprising:

a case main body containing a window hole;

a plurality of ink storage bags accommodated in said case main body; and a plurality of detection plates, each having a detectable piece with a pointer part having a pointed end formed thereon;

wherein each one of said detection plates is attached to each of said plurality of ink storage bags, respectively; and wherein said pointer parts confront each other and are exposed for visual observation from said window hole.

5. An ink feed container as claimed in claim 4 further comprising:

a lid body with engagement parts formed integrally thereon that engage with said case main body, wherein said lid body seals an opening of said case main body.

6. An ink feed container as claimed in claim 2 further comprising a detection lever arranged such that one of said detectable pieces of one of said detection plates attached to one of said ink storage bags contacts said detection lever when said one of said ink storage bags is essentially empty.

7. An ink feed container as claimed in claim 4 further comprising a detection lever arranged such that one of said detectable pieces of one of said detection plates attached to one of said ink storage bags contacts said detection lever when said one of said ink storage bags is essentially empty.

8. An ink feed container as claimed in claim 2, wherein said plurality of ink storage bags have respective ink feed ports, further comprising:

a common positioning part provided on an end wall inner surface of said case main body for positioning and locking of said respective ink feed ports.

9. An ink feed container as claimed in claim 2 further comprising:

a lid body with engagement parts formed integrally thereon that engage with said case main body, wherein said lid body seals an opening of said case main body.

10. An ink feed container as claimed in claim 4, wherein said plurality of ink storage bags have respective ink feed ports, further comprising:

a common positioning part provided on an end wall inner surface of said case main body for positioning and locking of said respective ink feed ports.

* * * * *